United States Patent [19]

Hay

[11] 4,139,237

[45] Feb. 13, 1979

[54] BREAKER BAR

[75] Inventor: Harold L. Hay, Portland, Oreg.

[73] Assignee: Columbia Steel Casting Co., Inc., Portland, Oreg.

[21] Appl. No.: 769,957

[22] Filed: Feb. 18, 1977

[51] Int. Cl.[2] ..... E01C 23/12; E21C 47/10

[52] U.S. Cl. ..... 299/94; 241/273

[58] Field of Search ..... 299/94; 175/409, 414, 175/420, 419, 398; 241/291, 273; 125/40, 41, 42, 43

[56] References Cited

U.S. PATENT DOCUMENTS

| | | | |
|---|---|---|---|
| 2,209,619 | 7/1940 | Wilcox | 175/420 |
| 2,342,498 | 2/1944 | Spang | 175/398 |
| 2,524,589 | 10/1950 | Becker | 241/273 UX |
| 3,236,510 | 2/1966 | O'Brien | 175/414 |
| 3,404,847 | 10/1968 | Smith | 241/291 |
| 3,845,893 | 11/1974 | Banjavich | 241/273 |

*Primary Examiner*—Ernest R. Purser
*Assistant Examiner*—William F. Pate, III
*Attorney, Agent, or Firm*—Thomas M. Freiburger

[57] ABSTRACT

A breaker bar or drop hammer principally for breaking large rock into smaller pieces is disclosed. The bar is of a cast heat treatable material, preferably manganese steel, and is of a shape which permits effective heat treatment quenching for adequate strength. Preferred shapes for the one-piece breaker bar are easily cast and avoid thicknesses of over about eight inches in critical areas, so that quenching is effective to avoid deleterious thermal stress cracking and provide a structure of adequate strength.

3 Claims, 8 Drawing Figures

FIG_1
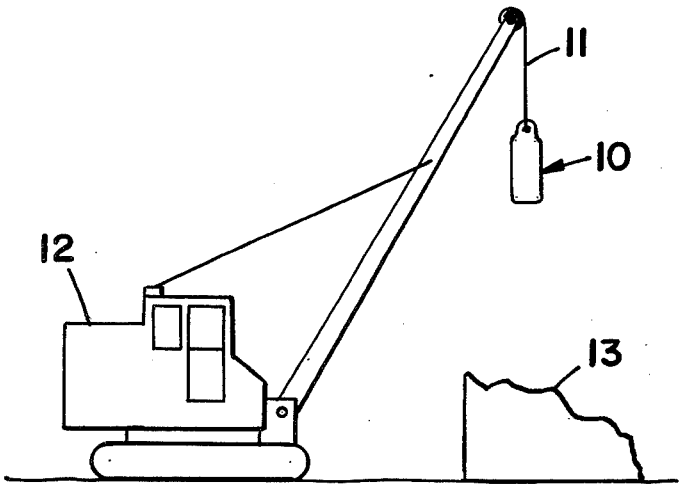
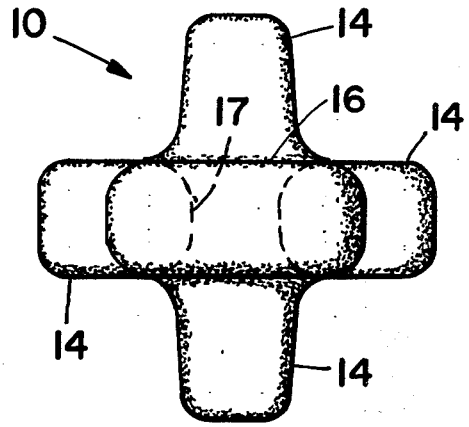
FIG_3
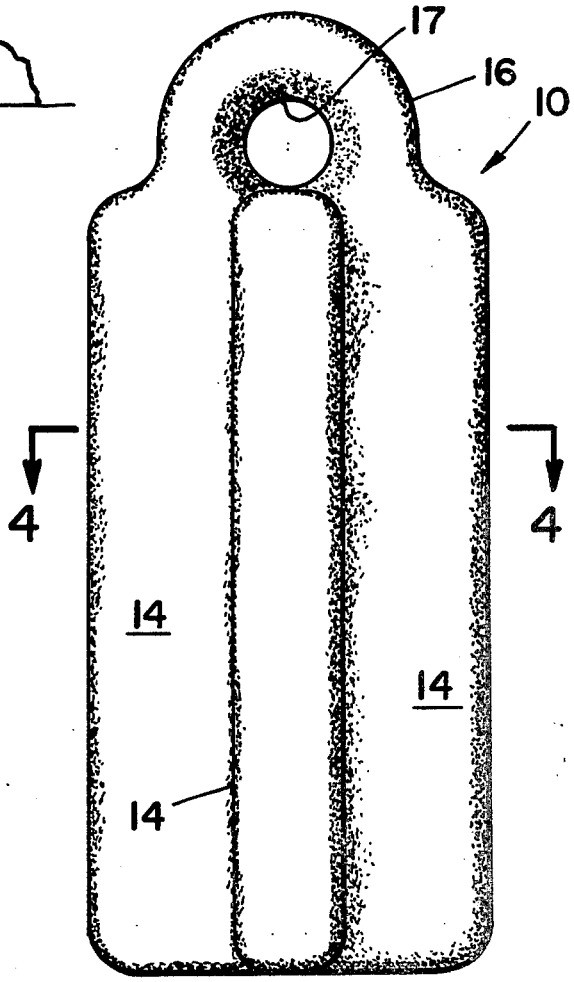
FIG_2
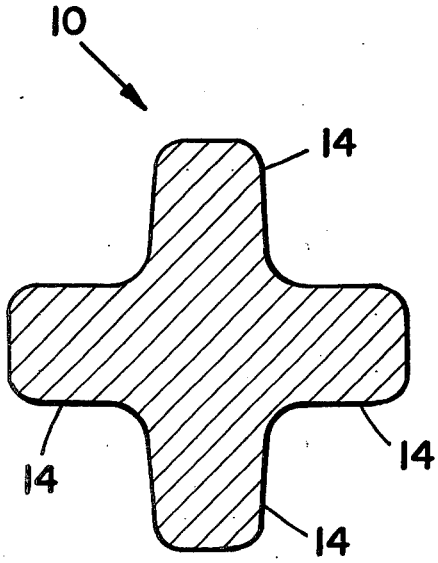
FIG_4

BREAKER BAR

BRACKGROUND OF THE INVENTION

The present invention relates generally to an improved massive body or weight of the type utilized for breaking rocks or other materials and which may also be utilized in various other types of demolition operations. In its principal aspect the invention is concerned with an improved breaker bar of this type having greater toughness, hardness, strength and durability to withstand high impact and heavy abrasion in service.

It has been common practice in quarrying operations or the like to utilize a very heavy inertia body to break large rocks or other materials into smaller pieces thereby rendering the material more suitable for subsequent handling. When rock is dynamited loose in a quarry, frequently the size of the rock obtained is still too large to be crushed by rotary or other available types of mechanical crushers. Heavy bodies, commonly referred to as breaker balls or drop hammers, have been utilized to further break the rock to a more useful size by lifting the ball to a required height with a crane and allowing the ball to freely drop on the oversized rock to be broken.

In order to break large rock pieces into acceptable sizes, the ball has been required to be quite heavy, especially when working with granite or other hard rock. However, such weight has been accompanied by high impact and extreme abrasion in service, and there have been problems of fracture as well as wear with these breaker balls or drop hammers.

One approach to this problem has been to provide a mutliple piece breaker ball having a replaceable bottom impact and wear portion.

However, such replaceable bottoms have been found to last only a short time, requiring frequent replacement, in addition to requiring a more complex structure in the original manufacture.

Another approach has been to use metals or metal treatment methods which yield a high resistance to impact stresses and abrasion to which these breaker balls are subjected. U.S. Pat. No. 3,404,847 disclosed the use of a heat treatable metal such as austenitic manganese steel in a breaker ball. To overcome the problem of proper quenching of a heavy, normally extremely thick mass of such heat treatable material, the patent proposed a system of passageways through a generally cylindrical ball, each passageway open at both ends to the exterior of the ball to admit a quenching liquid pursuant to a heat treating operation. This was to avoid overly thick masses of the heat treatable material in any portion of the ball. As explained in the patent, the high coefficient of thermal expansion and low heat conductivity of manganese steel result in a great difference in the cooling rates of the exterior and interior of a mass of manganese steel when it is subjected to the drastic heat treatment required to form articles of the material. To dissolve the carbide in the austenite, manganese steel must be heated to over 1800° F. and quenched in cold water; however, the "lag" of the inside of the metal in cooling, coupled with the high coefficient of expansion, sets up stresses of such magnitude that large sections of manganese steel of thicknesses greater than the effective penetration depth of the coolant cannot be quenched without producing cracks.

While generally providing a possible solution to the problems discussed above, the breaker ball or drop hammer of U.S. Pat. No. 3,404,847 involves rather complex structure for casting, with the large number of arcuate and rectangular passages required. It is an object of the present invention to provide a breaker ball or bar of much simpler construction but which still avoids overly thick regions so that effective heat treatment quenching can be achieved.

SUMMARY OF THE INVENTION

The breaker bar of the present invention can be cast of a heat treatable steel and quenched effectively via its external surfaces alone, without the provision of interior passageways. Preferred shapes for the breaker bar are easily and economically cast and are structurally sound. In each case the shape of the bar is elongated and of a generally uniform cross section which comprises a plurality of connected walls of approximately eight inches or less in thickness so that quenching results in the required strength for the type of service contemplated. In the preferred embodiment of the invention the breaker bar is an elongated austenitic manganese steel bar of cruciform shaped cross section, with walls of five to eight inch thickness. This shape exposes a very large surface area to the external quenching medium while still enabling the provision of a sufficiently heavy article for rock breaking and demolition purposes.

Other cross sectional shapes which may be advantageously utilized in the present invention are an H-shape, a T-shape and other shapes involving a plurality of generally rectangular walls extending outwardly from an intersection area.

It is therefore among the objects of the invention to provide a breaker bar of high strength and wear resistance but which also avoids complex structure, being easily and economically cast of a heat treatable metal such as manganese steel. Other objects, advantages and features of the invention will be apparent from the following description of several preferred embodiments, taken in conjunction with the appended drawings.

DESCRIPTION OF THE DRAWINGS

FIG. 1 is an exemplary illustration showing a breaker bar or drop hammer according to the invention suspended from a crane for breaking large rock into smaller pieces;

FIG. 2 is a view in side elevation of a preferred form of a breaker bar incorporating the features of the invention;

FIG. 3 is a plan view of the breaker bar of FIG. 2;

FIG. 4 is a sectional view of the breaker bar taken along the line 4—4 of FIG. 2;

DESCRIPTION OF THE PREFERRED EMBODIMENTS

Figure 6:
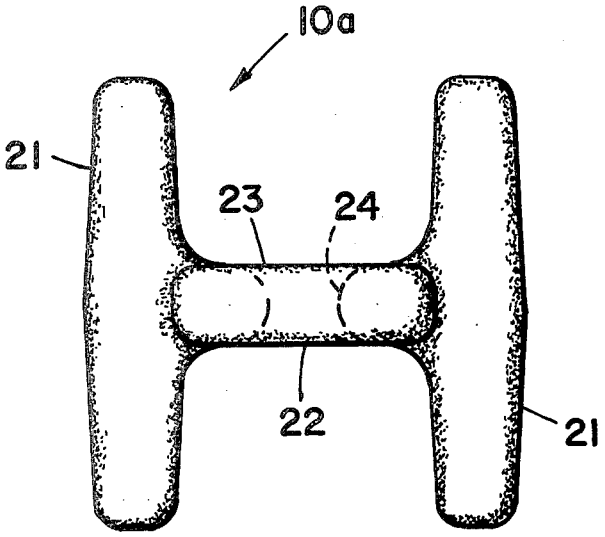
FIG. 6 is a plan view of the breaker bar of FIG. 5.

In the drawings, FIG. 1 illustrates a breaker bar or drop hammer 10 suspended on a line 11 of a traveling crane 12, which lifts the bar 10 to the required height, then allows it to drop freely on a mass of rock 13 or other object, in order to break the rock or other object into smaller pieces for subsequent handling. The breaker bar 10 may be of any desired weight, but typically will be generally in the range of 5,000 to 10,000 pounds.

As shown in FIGS. 2, 3 and 4, the breaker bar 10, according to a preferred embodiment of the invention, includes a plurality of generally rectangular fins or walls 14 which extend outwardly from a central intersection in generally a cruciform or X-shaped cross-sectional shape. The bar 10 is preferably of an elongated configuration substantially uniform in cross-section, the cross-section being illustrated in FIG. 4.

A salient feature of the invention is that each of the fins or walls 14 is of a thickness that permits proper quenching of the heat treatable steel material from which the bar is cast. This material is preferably austenitic manganese steel, a material which when properly heat treated has been found to exhibit high strength and abrasion resistance properties. The thickness of each wall 14 is most preferably from about five inches to about eight inches. Below five inches the walls would have to be too large in length and/or width to provide the required weight, and thus would lose structural integrity and concentration of mass at the impact area. Approximately eight inches has been found to be the maximum wall thickness for adequate quenching of austenitic manganese steel to provide the strength required for this type of service. The cross section shown provides a very large surface area to weight ratio, with no overly thick masses, and on quenching provides for adequately rapid cooling in all areas of the bar. Of course, the central intersection area of the bar 10 has a diagonal or diametral dimension greater than eight inches, so that its core is not ideally quenched, but this area seems less critical than the fins 14 in that it does not seem to absorb the kind of impact stresses that the fins absorb.

FIGS. 2 and 3 also illustrate a cable connecting means at the top of the breaker bar. This means may be in the form of a loop 16 having an eye opening 17 which is rounded at its edges to better resist wear by the cable.

Figure 5:
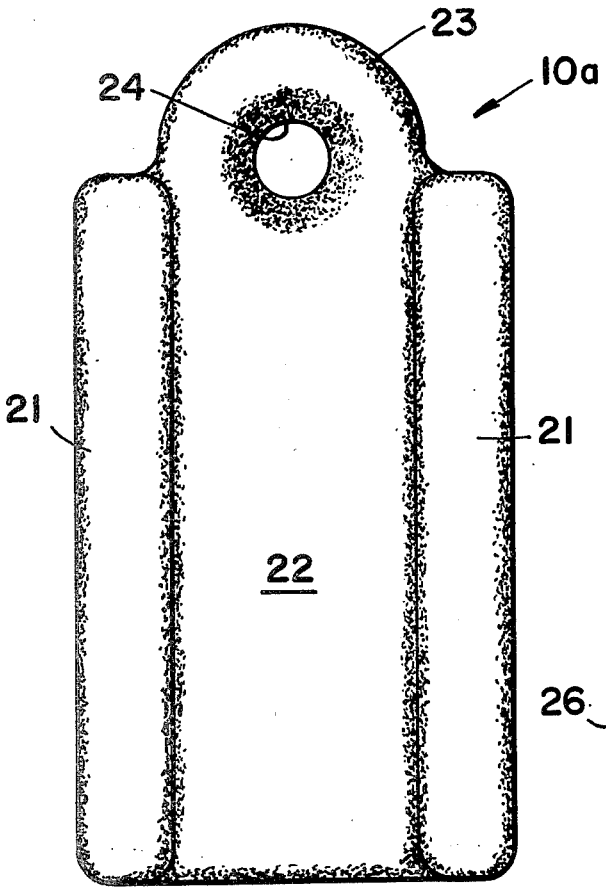
FIG. 5 is a view in side elevation of another form of breaker bar according to the invention.

FIGS. 5 and 6 show another form of a breaker bar according to the invention. The bar 10*a* is of an H-shaped cross section, including a pair of exterior walls or flanges 21 and a central connecting wall or web 22. The walls 21 and 22 are similar to the walls 14 of the above embodiment, within the same range of thickness for proper heat treatment quenching. Approximately eight inches is the maximum thickness of any portion of the web or flanges, with this maximum found at the center of each flange where it adjoins the web, since the flanges are slightly tapered as shown.

As in the breaker bar 10 of FIGS. 2—5, the breaker bar 10*a* includes an integrally cast cable connecting device 23 in the form of an upper loop forming an eye opening 24, rounded at its edges.

Figure 8:
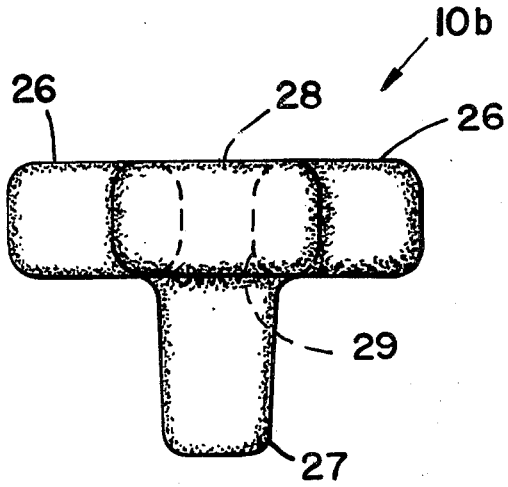
FIG. 8 is a plan view of the breaker bar of FIG. 7.
Figure 7:
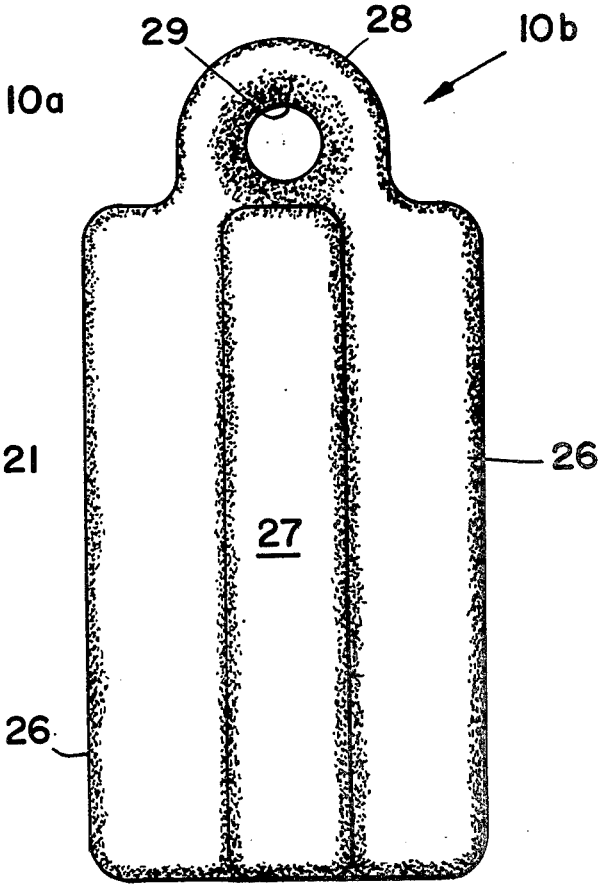
FIG. 7 is a side elevation view of still another embodiment of a breaker bar according to the invention.

FIGS. 7 and 8 show a third form of a breaker bar according to the invention. The breaker bar 10*b* is T-shaped in cross section, as best seen in the plan view of FIG. 8, including intersecting walls or flanges 26 and 27. These walls, like those of the above described embodiments, are of about five to eight inches thickness for a bar of austenitic manganese steel, the preferred material. A cable connector 28 at the top end of the bar 10*b* defines an eye opening 29.

Other similar shapes can also be employed to form a breaker bar in accordance with the principles of the invention. For example, the breaker bar can be Y-shaped in cross section, or it can have more than four walls extending outwardly from a central intersection point. These and other variations to these preferred embodiments will be apparent to those skilled in the art and may be made without departing from the spirit and scope of the invention as defined in the following claims.

I claim:

1. A breaker bar for use in quarrying and other operations for dropping onto large frangible masses to be broken into smaller pieces, comprising a heavy body of cast austenitic magnanese steel in a vertically elongated shape of generally planarly sided walls extending outwardly from a central intersection, said walls terminating in a substantially blunt bottom end, each wall being of a substantially uniform thickness of from about five to about eight inches, whereby the walls are sufficiently thick to provide an adequately concentrated mass in the breaker bar, without exceeding the maximum wall thickness of said manganese steel which can be quenched upon heat treatment to provide a desired internal structure resulting in adequate strength and wear resistance for the breaker bar.

2. The breaker bar of claim 1 wherein said cross section is generally cruciform shaped.

3. The breaker bar of claim 1 wherein said cross section is generally T-shaped.

* * * * *